US008821695B2

(12) United States Patent
Sato et al.

(10) Patent No.: US 8,821,695 B2
(45) Date of Patent: Sep. 2, 2014

(54) COAL REFORMING SYSTEM

(75) Inventors: Fumiaki Sato, Tokyo (JP); Setsuo Omoto, Tokyo (JP); Makoto Susaki, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/405,608

(22) Filed: Feb. 27, 2012

(65) Prior Publication Data

US 2012/0241306 A1 Sep. 27, 2012

(30) Foreign Application Priority Data

Mar. 22, 2011 (JP) ..... 2011-062458

(51) Int. Cl.

| | |
|---|---|
| ***C10B 9/00*** | (2006.01) |
| ***C10F 5/06*** | (2006.01) |
| ***C10B 49/02*** | (2006.01) |
| ***C10F 7/00*** | (2006.01) |
| ***C10F 5/00*** | (2006.01) |
| ***C10B 57/10*** | (2006.01) |
| ***C10L 9/08*** | (2006.01) |

(52) U.S. Cl.

CPC . *C10B 49/02* (2013.01); *C10F 5/06* (2013.01); *C10F 7/00* (2013.01); *C10F 5/00* (2013.01); *C10B 57/10* (2013.01); *C10L 9/08* (2013.01)

USPC ..... 202/96; 202/109; 44/592; 44/599; 44/608; 44/620

(58) Field of Classification Search

USPC ..... 202/96, 109; 44/608, 620, 592, 599

See application file for complete search history.

(56) References Cited

U.S. PATENT DOCUMENTS

| | | | | | |
|---|---|---|---|---|---|
| 4,511,363 | A | * | 4/1985 | Nakamura et al. | 44/608 |
| 4,533,438 | A | * | 8/1985 | Michel et al. | 201/31 |
| 4,668,244 | A | * | 5/1987 | Nakamura et al. | 44/591 |
| 5,322,530 | A | * | 6/1994 | Merriam et al. | 44/608 |
| 5,401,364 | A | | 3/1995 | Rinker | |
| 5,556,436 | A | * | 9/1996 | Yagaki et al. | 44/626 |
| 5,711,769 | A | * | 1/1998 | Rinker et al. | 44/620 |
| 6,162,265 | A | * | 12/2000 | Dunlop et al. | 44/626 |

(Continued)

FOREIGN PATENT DOCUMENTS

| | | | |
|---|---|---|---|
| CN | 101818081 | A | 9/2010 |
| CN | 101885973 | A | 11/2010 |

(Continued)

OTHER PUBLICATIONS

Japanese Notice of Allowance dated Jan. 31, 2012, issued in corresponding Japanese Patent Application No. 2011-062458, (6 pages). With English Translation.

(Continued)

*Primary Examiner* — Nina Bhat

(74) *Attorney, Agent, or Firm* — Westerman, Hattori, Daniels & Adrian, LLP

(57) ABSTRACT

A coal reforming system includes a drying furnace for drying low-grade coal, a carbonizing furnace for carbonizing the dried low-grade coal, hot air generating furnaces for supplying hot air to the drying furnace or the carbonizing furnace, and a carbonizing gas circulation line for supplying a carbonizing gas, which is generated in the carbonizing furnace, as a fuel for the hot air generating furnaces while the temperature thereof is maintained.

4 Claims, 2 Drawing Sheets

(56) References Cited

U.S. PATENT DOCUMENTS

| | | | | |
|---|---|---|---|---|
| 6,942,707 | B2 * | 9/2005 | Goraczko | 44/620 |
| 8,197,561 | B2 * | 6/2012 | Dunlop et al. | 44/620 |
| 8,252,070 | B2 * | 8/2012 | Sugita et al. | 44/282 |

FOREIGN PATENT DOCUMENTS

| | | | |
|---|---|---|---|
| JP | 49-001761 | B | 1/1974 |
| JP | 59-040185 | B | 9/1984 |
| JP | 61-053390 | A | 3/1986 |
| JP | 61-183391 | A | 8/1986 |
| JP | 2000-265186 | A | 9/2000 |
| JP | 2007-314624 | A | 12/2007 |
| JP | 2008-184531 | A | 8/2008 |
| JP | 2008-201964 | A | 9/2008 |
| JP | 2011-037937 | A | 2/2011 |
| JP | 2011-037938 | A | 2/2011 |
| JP | 4719298 | B2 | 4/2011 |
| JP | 2011-127010 | A | 6/2011 |

OTHER PUBLICATIONS

Japanese Office Action dated Nov. 15, 2011, issued in corresponding Japanese Patent Application No. 2011-062458.

Chinese Office Action dated Mar. 17, 2014, issued in corresponding Chinese Patent Application No. 201210056629.9, w/English translation (12 pages).

Chinese Office Action dated Jul. 8, 2013, issued in corresponding Chinese Application No. 201210056629.9 w/English translation.

* cited by examiner

COAL REFORMING SYSTEM

CROSS-REFERENCE TO RELATED APPLICATION

This application claims priority from Japanese Patent Application No. 2011-062458 filed Mar. 22, 2011, which is incorporated herein by reference in its entirety.

BACKGROUND OF THE INVENTION

The present invention relates to a coal reforming system for reforming low-grade coal, such as brown coal and subbituminous coal, having a high water content.

For low-grade coal, such as brown coal and subbituminous coal, having a high water content, although the estimated amount of coal deposits is large, the calorific value per unit weight is low, and transportation efficiency is poor, so that there has been performed processing to increase the calorific value per unit weight by subjecting the coal to heating treatment to dry it. A coal reforming system for reforming such low-grade coal has been disclosed in U.S. Pat. No. 5,401,364.

SUMMARY OF THE INVENTION

FIG. 2 shows the prior art's coal reforming system which includes a drying furnace 110 for evaporating and removing water from low-grade coal by hot-air drying, and a carbonizing furnace 120 for carbonizing and reforming the dried coal. In this system, however, a tar recovery apparatus 130 for separating and recovering byproduct tar from a carbonizing gas generated in the carbonizing furnace 120 has problems in that a large energy loss occurs because the carbonizing gas is cooled by a spray nozzle, and also the apparatus is huge and the construction cost is high.

Also, if the outlet gas temperature of the tar recovery apparatus 130 is raised, and a circulating gas containing tar is used as a dilution gas of hot air sent from a hot air generating furnace 140 for a carbonizing furnace via a line 138*a* to suppress a heat loss at the time of tar recovery, there arises a problem that coking occurs at the meeting point of the line 138*a* and a line 142 of the hot air sent from the hot air generating furnace 140 for a carbonizing furnace.

Furthermore, the byproduct tar recovered by the tar recovery apparatus 130 is a fuel that has low thermal stability, is liable to be deteriorated, and therefore has a low added value. Also, the byproduct tar has a problem that the compatibility thereof with petroleum-based fuel is poor, so that the use as a fuel is restricted.

The present invention has been made to solve the above problems, and accordingly an object thereof is to provide a coal reforming system capable of improving the thermal efficiency at a low equipment cost without the occurrence of coking.

To achieve the above object, a coal reforming system in accordance with the present invention is characterized by including a drying device for drying low-grade coal; a carbonizing device for carbonizing the dried low-grade coal; a hot air supplying device for supplying hot air to the drying device or the carbonizing device; and a carbonizing gas circulation line for supplying a carbonizing gas, which is generated in the carbonizing device, as a fuel for the hot air supplying device while the temperature thereof is maintained.

Preferably, the coal reforming system in accordance with the present invention further includes a heat exchanger for recovering heat from hot air generated in the hot air supplying device before the hot air is supplied to the drying device or the carbonizing device, and further includes a power generating device for generating electric power by means of the heat recovered by the heat exchanger.

As described above, according to the present invention, since the carbonizing gas generated in the carbonizing device is supplied as a fuel to the hot air supplying device for supplying hot air to the drying device or the carbonizing device for low-grade coal while the temperature thereof is maintained, tar is not recovered from the carbonizing gas in a tar recovery apparatus, unlike the conventional system. Therefore, equipment such as a tower for cooling and cleaning the carbonizing gas, a heat exchanger, an electric precipitator for removing fume-form tar in the gas, and a tar storage tank need not be provided, so that the construction cost can be reduced significantly. Also, in the conventional tar recovery apparatus, the sensible heat and latent heat of tar are lost in the heat exchanger in the circulation loop of tar. According to the present invention, however, the heat that the tar has can be utilized effectively, so that the thermal efficiency can be improved. Furthermore, since the carbonizing gas is reused as a fuel for the hot air supplying device, not as a dilution gas of hot air, there is no fear of occurrence of coking.

DESCRIPTION OF THE PREFERRED EMBODIMENTS

One embodiment of a coal reforming system in accordance with the present invention will now be described with reference to the accompanying drawing. In the figures, a blower for blowing gas and valves and the like for regulating the supply amount of gas are omitted.

Figure 1:
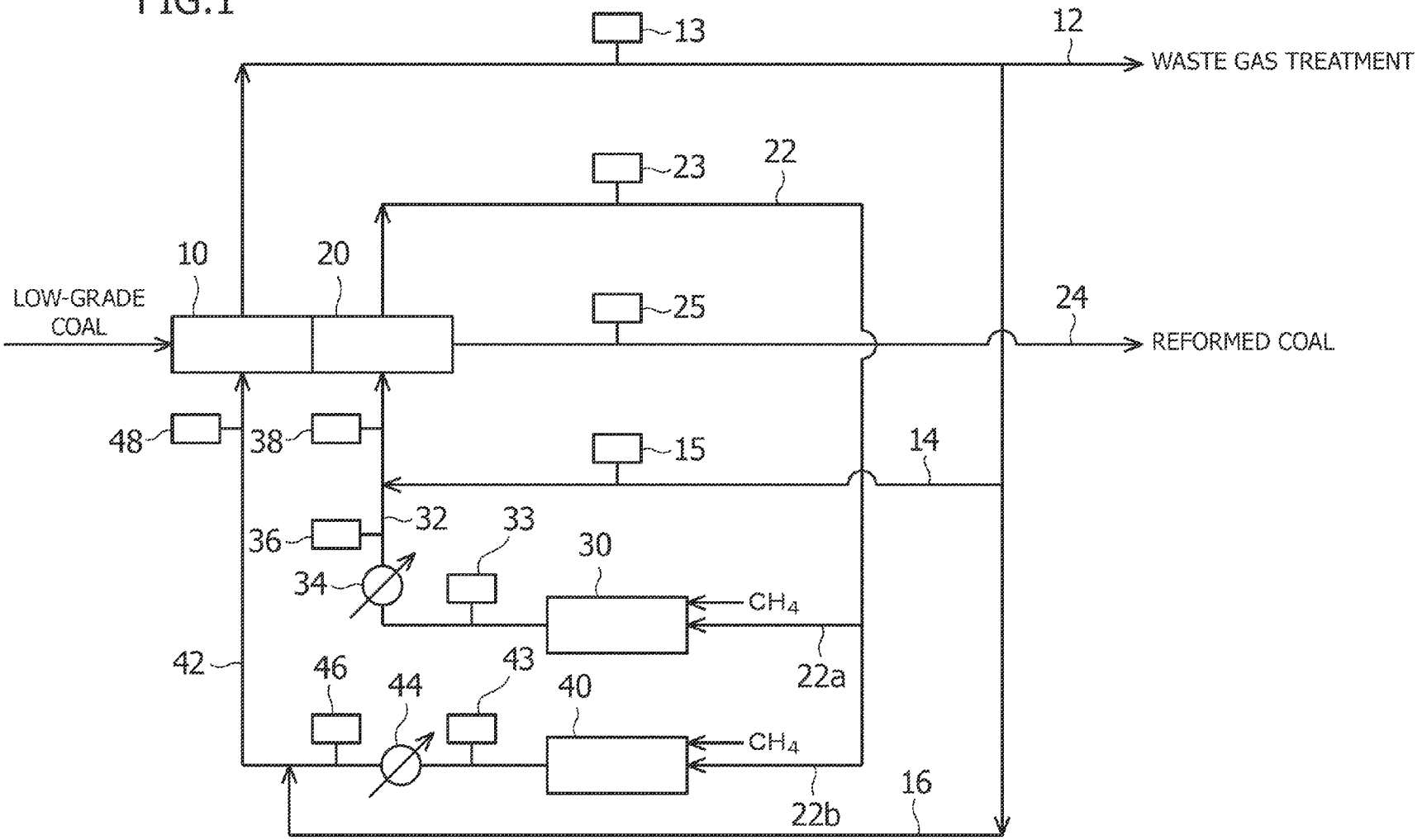
FIG. 1 is a block diagram showing one embodiment of a coal reforming system in accordance with the present invention.

As shown in FIG. 1, the coal reforming system of this embodiment mainly includes a drying furnace 10 for drying a raw material such as low-grade coal, a carbonizing furnace 20 for carbonizing the dried raw material, a hot air generating furnace 30 for a carbonizing furnace that supplies hot air for carbonizing to the carbonizing furnace 20, and a hot air generating furnace 40 for a drying furnace that supplies hot air for drying to the drying furnace 10.

The drying furnace 10 is an apparatus capable of heating a charged raw material to a temperature in the range of 110 to 200° C. by hot air and removing water contained in the raw material. In this embodiment, the drying furnace 10 is a heating apparatus of a system such that hot air is brought into direct contact with the raw material. However, any other heating system may be used if it can dry the raw material without burning; for example, an externally heated system in which hot air is brought into indirect contact with the raw material may be used. The drying furnace 10 includes a raw material inlet for introducing the raw material, a raw material outlet for supplying the dried raw material to the carbonizing furnace 20, a hot air inlet for introducing hot air, and a waste gas outlet for exhausting hot air after drying.

The carbonizing furnace 20 is an apparatus capable of heating the dried raw material to a temperature in the range of 300 to 450° C. by hot air, carbonizing the raw material of low-grade coal, and converting the low-grade coal into reformed coal. In this embodiment, the carbonizing furnace 20 is a heating apparatus of a system such that hot air is brought into direct contact with the raw material, and the atmosphere in the interior of the furnace is maintained with a low oxygen level so that the raw material does not burn. An externally heated system in which hot air is brought into indirect contact with the raw material may be used. The carbonizing furnace 20 includes a raw material inlet for introducing the raw material from the drying furnace 10, a reformed coal outlet for discharging reformed coal, a hot air inlet for introducing hot air, and a gas outlet for exhausting the hot air having been used for carbonization.

The hot air generating furnace 30 for a carbonizing furnace is an apparatus that burns a fuel to generate hot air for the carbonizing furnace 20, the hot air having a temperature in the range of 400 to 1660° C. The hot air generating furnace 30 for a carbonizing furnace includes a fuel gas inlet for introducing the carbonizing gas sent from the carbonizing furnace 20 as a fuel, an auxiliary fuel inlet for introducing an auxiliary fuel, such as methane, used to obtain a low-oxygen gas, and a hot air outlet for exhausting the hot air.

The hot air generating furnace 40 for a drying furnace is an apparatus that burns a fuel to generate hot air for the drying furnace 10, the hot air having a temperature in the range of 400 to 1660° C. The hot air generating furnace 40 for a drying furnace includes a fuel gas inlet for introducing the carbonizing gas sent from the carbonizing furnace 20 as a fuel, an auxiliary fuel inlet for introducing an auxiliary fuel, such as methane, used to obtain a low-oxygen gas, and a hot air outlet for exhausting the hot air. In FIG. 1, two hot air generating furnaces for the drying furnace 10 and the carbonizing furnace 20 are provided. However, one common hot air generating furnace can be provided.

The drying furnace 10 is provided with a waste gas line 12, which sends the hot air after drying to an waste gas treatment apparatus (not shown), at the waste gas outlet thereof.

The carbonizing furnace 20 is provided with a carbonizing gas circulation line 22, which sends the carbonizing gas containing the hot air after carbonization and the tar produced by carbonization to the fuel gas inlets of the hot air generating furnace 30 for a carbonizing furnace and the hot air generating furnace 40 for a drying furnace while the temperature thereof is maintained, at the gas outlet thereof. Also, the carbonizing furnace 20 is provided with a reformed coal discharge line 24 for discharging reformed coal at the reformed coal outlet thereof. On this reformed coal discharge line 24, a molding machine (not shown) for molding reformed coal into a predetermined shape can also be provided.

The hot air generating furnace 30 for a carbonizing furnace is provided with a carbonizing hot air supply line 32, which sends hot air to the hot air inlet of the carbonizing furnace 20, at the hot air outlet thereof. On this carbonizing hot air supply line 32, a heat exchanger 34 for carrying out heat exchange with hot air and a first waste gas circulation line 14 for sending some of the waste gas after drying of the waste gas line 12 to the carbonizing furnace 20 are provided in the named order from the side of the hot air generating furnace 30 for a carbonizing furnace.

The hot air generating furnace 40 for a drying furnace is provided with a drying hot air supply line 42, which sends hot air to the hot air inlet of the drying furnace 10, at the hot air outlet thereof. On this drying hot air supply line 42, a heat exchanger 44 for carrying out heat exchange with hot air and a second waste gas circulation line 16 for sending some of the waste gas after drying of the waste gas line 12 to the drying furnace 10 are provided in the named order from the side of the hot air generating furnace 40 for a drying furnace.

On the respective lines, thermometers 13, 15, 23, 25, 33, 36, 38, 43, 46 and 48 for measuring the temperatures of gases and reformed coal in the lines are provided.

According to the above-described configuration, first, coal, which is a raw material, is supplied to the drying furnace 10. As the coal, low-grade coal, such as lignite, brown coal, subbituminous coal, and peat, containing 15 to 70%, preferably 20 to 40% of water is used. In the drying furnace 10, the low-grade coal is dried until the water content thereof becomes approximately 0%. The drying operation in the drying furnace 10 is performed by bringing the hot air having a temperature of 150 to 300° C., which is introduced from the hot air generating furnace 40 for a drying furnace through the drying hot air supply line 42, into direct contact with the low-grade coal. The waste gas after drying is sent to the waste gas treatment apparatus (not shown) via the waste gas line 12, and some of the waste gas is circulatingly used through the first and second waste gas circulation lines 14 and 16.

The temperature of the hot air sent from the hot air generating furnace 40 for a drying furnace is higher than the gas temperature necessary for drying in the drying furnace 10. Therefore, the temperature of the hot air of the hot air generating furnace 40 for a drying furnace is lowered to a temperature of, for example, 400 to 550° C. by the heat exchanger 44, and thereafter can further be lowered to the range of 200 to 300° C. by mixing with the waste gas having a temperature of 110 to 130° C. of the second waste gas circulation line 16. In the heat exchanger 44, heat can be recovered from hot air as steam. By using this recovered steam, electric power can be generated by using a generator (not shown). The generated electric power can be allotted to the power required for the coal reforming system, and, if there is a surplus, the surplus electricity can also be sold.

The low-grade coal having been dried in the drying furnace 10 is introduced into the carbonizing furnace 20. In the carbonizing furnace 20, carbonization is carried out by bringing the hot air, which is introduced from the hot air generating furnace 30 for a carbonizing furnace through the carbonizing hot air supply line 32, into direct contact with the low-grade coal. The hot air after carbonization and the carbonizing gas containing tar produced by carbonization are exhausted through the gas outlet of the carbonizing furnace 20. This exhaust gas has a temperature of 300 to 500° C., and is supplied to the fuel gas inlets of the hot air generating furnace 30 for a carbonizing furnace and the hot air generating furnace 40 for a drying furnace via the carbonizing gas circulation line 22 as a fuel while the temperature thereof is maintained.

Thus, unlike the conventional coal reforming system, the carbonizing gas generated in the carbonizing furnace 20 is supplied as a fuel for the hot air generating furnace 30 for a carbonizing furnace and the hot air generating furnace 40 for a drying furnace without recovering tar from the carbonizing gas in the tar recovery apparatus. Therefore, the heat of tar can be utilized effectively, and thereby the thermal efficiency of the coal reforming system can be improved.

The temperature of the hot air sent from the hot air generating furnace 30 for a carbonizing furnace is higher than the gas temperature necessary for carbonization in the carbonizing furnace 20. Therefore, the temperature of the hot air of the hot air generating furnace 30 for a carbonizing furnace is lowered to a temperature of, for example, 600 to 700° C., by the heat exchanger 34, and thereafter can further be lowered to the range of 350 to 550° C. by mixing with the waste gas having a temperature of 110 to 130° C. of the first waste gas circulation line 14. In the heat exchanger 34, as in the above-described heat exchanger 44 of the drying hot air, heat can be recovered from hot air as steam. By using this recovered steam, electric power can be generated by using the generator (not shown).

Example

Figure 2:
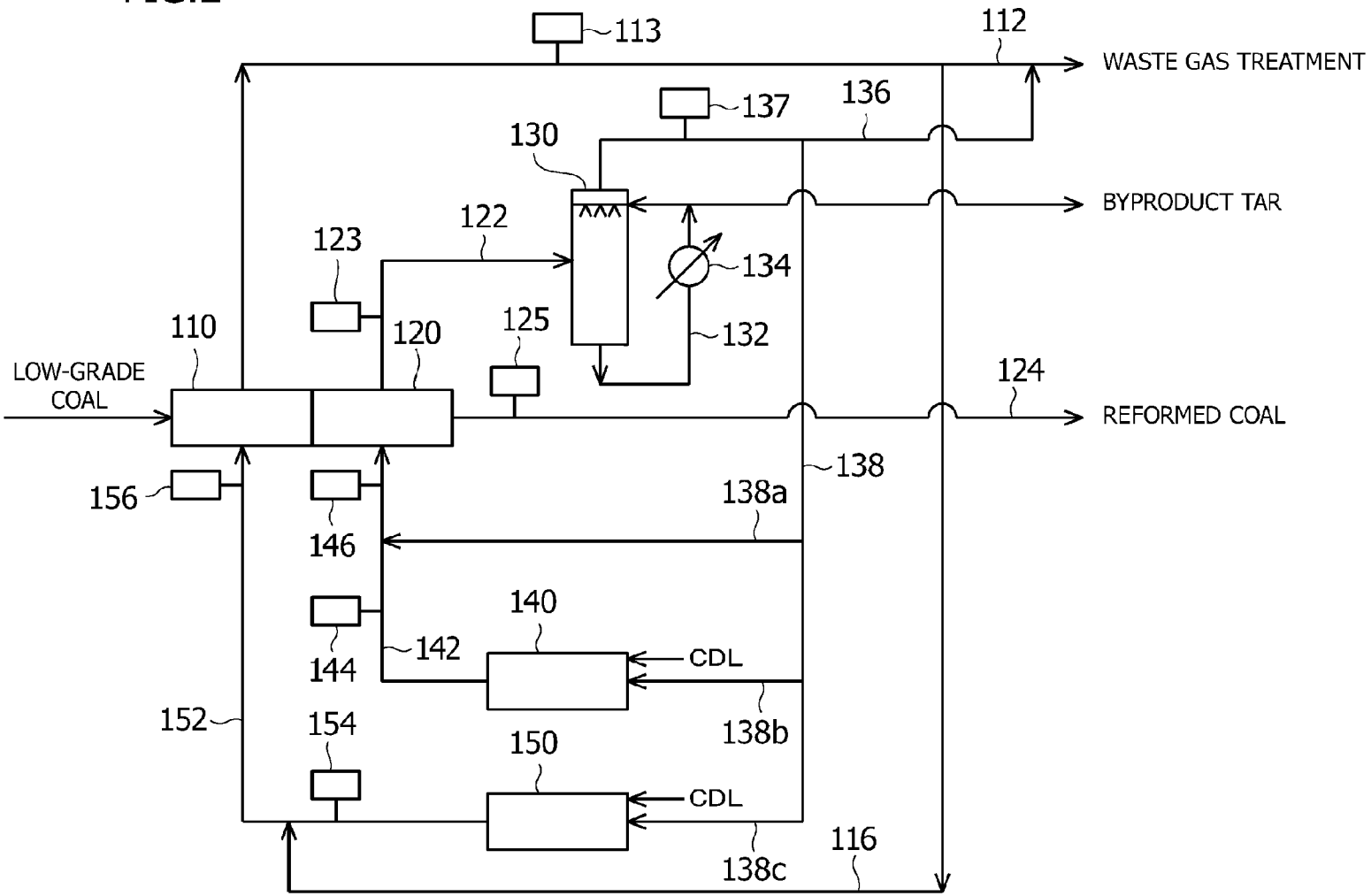
FIG.2 PRIOR ART
FIG. 2 is a block diagram showing one example of a conventional coal reforming system.

By using the coal reforming system shown in FIG. 1, a simulation in which low-grade coal was dried and carbonized was performed. Also, as comparative examples, a similar simulation was performed by using the coal reforming system shown in FIG. 2. The temperatures of the gases in the systems are given in Table 1. Also, the conditions and results of the simulations are given in Table 2.

TABLE 1

| | Comparative Example | Example |
|---|---|---|
| Thermometer 13, 113 (° C.) | 120 | 120 |
| Thermometer 15 (° C.) | — | 120 |
| Thermometer 23, 123 (° C.) | 350 | 350 |
| Thermometer 25, 125 (° C.) | 400 | 400 |
| Thermometer 137 (° C.) | 80 | — |
| Thermometer 33, 144 (° C.) | 1500 | 1660 |
| Thermometer 36 (° C.) | — | 620 |
| Thermometer 38, 146 (° C.) | 430 | 430 |
| Thermometer 43, 154 (° C.) | 1500 | 1660 |
| Thermometer 46 (° C.) | — | 430 |
| Thermometer 48, 156 (° C.) | 280 | 280 |

TABLE 2

| | Comparative Example | Example |
|---|---|---|
| Water content in low-grade coal (wt %) | 27 | 27 |
| Throughput of low-grade coal (wt ton/day) | 16,000 | 16,000 |
| Production of product coal (ton/day) | 9,000 | 9,000 |
| Details of input/output heat quantity | | |
| Calorific value of carried-in coal (MMkcal/hr) | 3,270 | 3,270 |
| Heat quantity supplied from outside (MMkcal/hr) | 323 | 19 |
| Electric power supplied from outside (MW) | 55 | 72 |
| Electric power supplied from outside (MMkcal/hr) | 47 | 62 |
| Occurring CDL (kg/day) | 600 | 0 |
| Heat quantity of occurring CDL (MMkcal/hr) | −213 | — |
| Total input heat quantity (MMkcal/hr) | 3,427 | 3,351 |
| Calorific value of product coal (MMkcal/hr) | 2,200 | 2,200 |
| Amount of recovered steam (ton/hr) | 309 | 420 |
| Heat quantity of recovered steam (MMkcal/hr) | 194 | 264 |
| Total output heat quantity (MMkcal/hr) | 2,394 | 2,464 |
| Thermal efficiency (%) | 69.9 | 73.5 |

As in Table 1, in the conventional system of the comparative examples, since cooling is performed by consuming a huge quantity of heat (about 190 MMkcal/hr) in a heat exchanger 134, in the case in which the cooled gas is recycled to the furnace, heat for reheating the cooled gas is necessary, so that the heat quantity supplied from the outside increases. Therefore, it can be seen that according to the coal reforming system in accordance with the present invention, the thermal efficiency can be improved as compared with the conventional system.

What is claimed is:

1. A coal reforming system comprising:

a drying device for drying low-grade coal by bringing hot air into direct contact with the low-grade coal;

a carbonizing device for carbonizing the dried low-grade coal by bringing hot air into direct contact with the dried low-grade coal, gas exhausted from the carbonizing device containing a carbonizing gas generated therein;

a hot air supplying device for supplying the hot air to the drying device or the carbonizing device, the carbonizing gas being reused as a fuel for the hot air supplying device; and a carbonizing gas circulation line for supplying the exhaust gas from the carbonizing device to the hot air supplying device, which is generated in the carbonizing device, as a fuel for the hot air supplying device while the temperature thereof is maintained without cooling the exhaust carbonizing gas; and a first waste gas circulation line for mixing the hot air to be supplied to the carbonizing device with a part of waste gas from the drying device to decrease a temperature of the hot air.

2. The coal reforming system according to claim 1, further comprising a heat exchanger for recovering heat from hot air generated in the hot air supplying device before the hot air is supplied to the drying device or the carbonizing device.

3. The coal reforming system according to claim 2, further comprising a power generating device for generating electric power by means of the heat recovered by the heat exchanger.

4. The coal reforming system according to claim 1, further comprising a second waste gas circulation line for mixing the hot air to be supplied to the drying device with a part of waste gas from the drying device to decrease a temperature of the hot air.

* * * * *